US011754348B2

(12) United States Patent
Jiang et al.

(10) Patent No.: US 11,754,348 B2
(45) **Date of Patent: *Sep. 12, 2023**

(54) MICROCHANNEL FLAT TUBE AND MICROCHANNEL HEAT EXCHANGER

(71) Applicant: HANGZHOU SANHUA RESEARCH INSTITUTE CO., LTD., Hangzhou (CN)

(72) Inventors: Haobo Jiang, Coconut Creek, FL (US); Li-zhi Wang, Hangzhou (CN); Jian-long Jiang, Hangzhou (CN); Lin-Jie Huang, East Amherst, NY (US)

(73) Assignee: HANGZHOU SANHUA RESEARCH INSTITUTE CO., LTD., Hangzhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/699,157

(22) Filed: Mar. 20, 2022

(65) Prior Publication Data

US 2022/0205736 A1 Jun. 30, 2022

Related U.S. Application Data

(63) Continuation of application No. 17/042,110, filed on Sep. 26, 2020, now Pat. No. 11,353,271.

(30) Foreign Application Priority Data

May 5, 2019 (CN) ..... 201910366880.7

(51) Int. Cl.

| | |
|---|---|
| ***F28F 1/02*** | (2006.01) |
| ***F28F 1/24*** | (2006.01) |
| ***F28F 1/12*** | (2006.01) |

(52) U.S. Cl.

CPC ..... *F28F 1/022* (2013.01); *F28F 1/128* (2013.01); *F28F 1/24* (2013.01); *F28F 2210/04* (2013.01);

(Continued)

(58) Field of Classification Search

CPC ..... F28F 1/022; F28F 1/128; F28F 2210/04; F28F 2215/02; F28F 2260/02

See application file for complete search history.

(56) References Cited

U.S. PATENT DOCUMENTS 4,570,700 A * 2/1986 Ohara ..... F25B 39/02 165/134.1
5,174,373 A * 12/1992 Shinmura ..... F28D 1/05391 165/102

(Continued)

FOREIGN PATENT DOCUMENTS

CN 1363818 A 8/2002
CN 1153943 C 6/2004

(Continued)

*Primary Examiner* — Devon Russell

(74) *Attorney, Agent, or Firm* — Cheng-Ju Chiang

(57) ABSTRACT

The present application discloses a microchannel flat tube and a microchannel heat exchanger. The microchannel flat tube includes a flat tube body and a row of channels. The row of channels is arranged in the flat tube body along a width direction. The row of channels extends through the flat tube body along a length direction. A cross-section of each channel includes a first width in the width direction and a first height in a thickness direction. The row of channels at least includes a first group of first channels, a second group of second channels and a third group of third channels along the width direction. The first widths of the first channels, the second channels and the third channels decrease at a fixed rate, thereby facilitating the control of the thickness of the (Continued)

microchannel flat tube and improving the heat exchange efficiency of the third channels.

19 Claims, 4 Drawing Sheets

(52) U.S. Cl.
CPC ..... *F28F 2215/02* (2013.01); *F28F 2260/02* (2013.01)

(56) References Cited

U.S. PATENT DOCUMENTS 8,234,881 B2 * 8/2012 Yanik ..... F28F 9/0243 62/515
2002/0066554 A1 * 6/2002 Oh ..... F28F 1/022 165/179
2002/0134537 A1 * 9/2002 Memory ..... B23K 1/0012 165/151
2004/0069477 A1 * 4/2004 Nishikawa ..... F28F 1/022 165/175
2005/0051317 A1 * 3/2005 Chin ..... F28F 1/126 165/177
2009/0166016 A1 * 7/2009 Hu ..... F28F 1/022 165/151
2013/0292098 A1 * 11/2013 Jindou ..... F28D 1/05391 165/143

FOREIGN PATENT DOCUMENTS

CN 101526322 A 9/2009
CN 202630766 U 12/2012
CN 101825404 B 5/2013
CN 204665753 U 9/2015
CN 206847460 U 1/2018
GB 2133525 A 7/1984
JP H08-178366 A 7/1996
JP 2005-127597 A 5/2005

* cited by examiner

MICROCHANNEL FLAT TUBE AND MICROCHANNEL HEAT EXCHANGER

CROSS-REFERENCE TO RELATED APPLICATION

This application is a continuation of U.S. patent application Ser. No. 17/042,110, filed Sep. 26, 2020, which is in condition for allowance, and is a 35 U.S.C. § 371 National Phase conversion of International (PCT) patent application No. PCT/CN2020/088553, filed on May 2, 2020, which claims benefit of a Chinese Patent Application No. 201910366880.7, filed on May 5, 2019, the entire content of which is hereby incorporated by reference.

TECHNICAL FIELD

The present application relates to a field of heat exchange technology, and specifically to a microchannel flat tube and a microchannel heat exchanger.

BACKGROUND

Micro-channel heat exchangers are heat exchange devices widely used in vehicle, household or commercial air-conditioning systems. The micro-channel heat exchanger can be used as an evaporator or a condenser in an air-conditioning system. The microchannel heat exchanger is a heat exchanger composed of flat tubes, fins, collecting pipes, etc. When wind generated by an external fan acts on microchannel fins and the flat tubes, a refrigerant in the flat tube flow channel of the microchannel heat exchanger exchanges heat with the air.

Each flat tube of the micro-channel heat exchanger has a flow channel composed of multiple small holes side by side, and the refrigerant evaporates or condenses in the side-by-side flow channel of the flat tube. When used as a condenser, the refrigerant is cooled in the side-by-side flow channel of the flat tube. When used as an evaporator, the refrigerant is evaporated in the side-by-side flow channel of the flat tube.

In the flat tube used in the related art, multiple side-by-side flow channels are flow channels with the same cross-sectional area. When the wind flows through the heat exchanger, due to the existence of heat transfer between the wind and the refrigerant, each side-by-side flow channel has a different refrigerant temperature along a wind flow direction. Therefore, along a refrigerant flow direction, the refrigerant evaporates or condenses at different positions in the side-by-side flow channels. This leads to a mismatch between flow distribution of the refrigerant in the flow channels and heat exchange temperature difference, which reduces the heat exchange efficiency of the heat exchanger.

SUMMARY

According to an aspect of the present application, a microchannel flat tube is provided and includes a flat tube body comprising a first plane, a second plane, a first side surface and a second side surface, the first plane and the second plane being disposed on opposite sides of the flat tube body along a thickness direction, the first side surface and the second side surface being disposed on opposite sides of the flat tube body along a width direction, the first side surface connecting the first plane and the second plane, the second side surface connecting the first plane and the second plane; and a row of channels disposed in the flat tube body along the width direction, the row of channels being adapted for an refrigerant to flow therethrough, the row of channels extending through the flat tube body along a length direction, each channel comprising a first width in the width direction and a first height in the thickness direction, the row of channels at least comprising a first group of first channels, a second group of second channels and a third group of third channels, the second group of second channels being disposed adjacent to the first group of first channels without any channel disposed between the second group of second channels and the first group of first channels along the width direction, the third group of third channels being disposed adjacent to the second group of second channels without any channel disposed between the third group of third channels and the second group of second channels along the width direction, the first channels, the second channels and the third channels being disposed in sequence along the width direction; wherein the first channels, the second channels and the third channels have the same first height, and the first channels, the second channels and the third channels have first widths which are decreased at a fixed rate, so that the first widths of the first channels, the second channels and the third channels decrease in a linear relationship.

According to an aspect of the present application, a microchannel heat exchanger is provided. The microchannel heat exchanger also includes a first collecting pipe, a second collecting pipe and fins. The microchannel flat tubes are connected between the first collecting pipe and the second collecting pipe. The fins are sandwiched between two adjacent microchannel flat tubes. A row of channels of the microchannel flat tubes communicate with an inner cavity of the first collecting pipe and an inner cavity of the second collecting pipe.

The first widths of the first channel, the second channel and the third channel described in present application are decreased at a fixed rate, so that channels with different flow cross-sectional areas can be obtained in this way. Therefore, the channels can be set correspondingly according to the wind direction. This is beneficial to improve the heat exchange efficiency of the microchannel flat tubes and the microchannel heat exchanger during operation. In addition, the first heights of the first channel, the second channel and the third channel are equal, therefore the material of the microchannel flat tube is effectively used and material waste is reduced.

DETAILED DESCRIPTION

Figure 1:
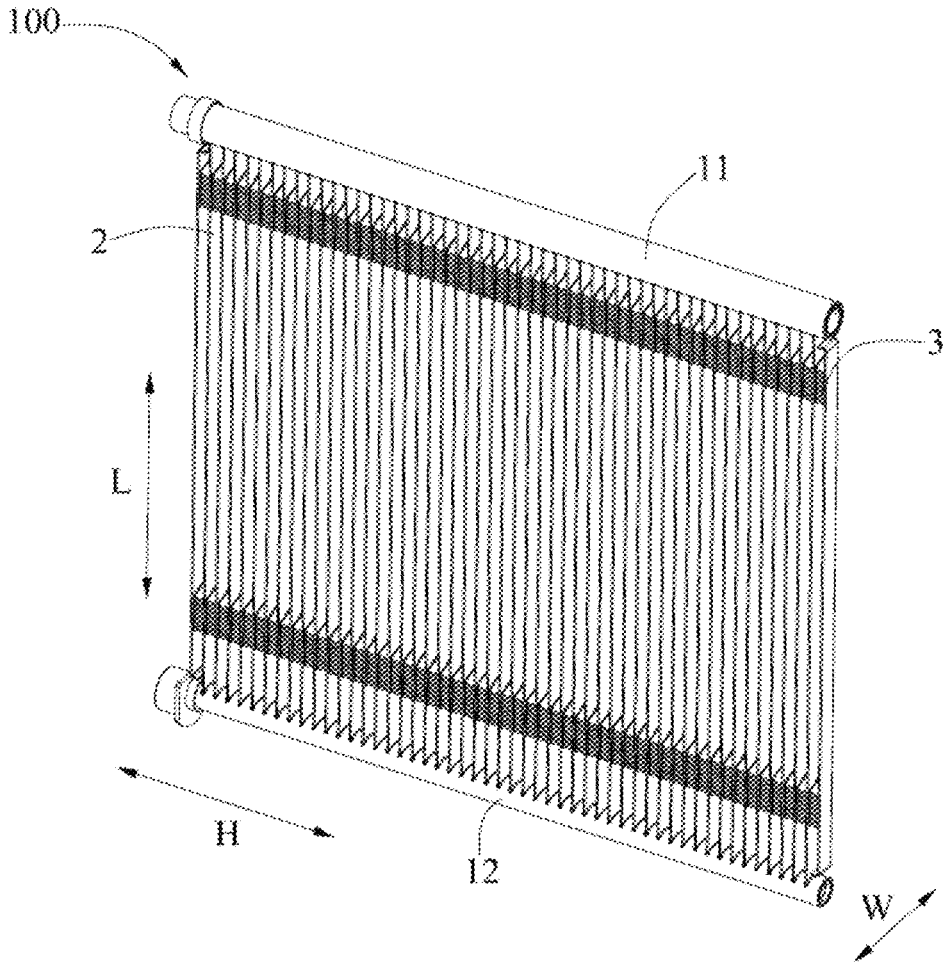
FIG. 1 is a schematic perspective view of a microchannel heat exchanger in accordance with an embodiment of the present application.
Figure 2:
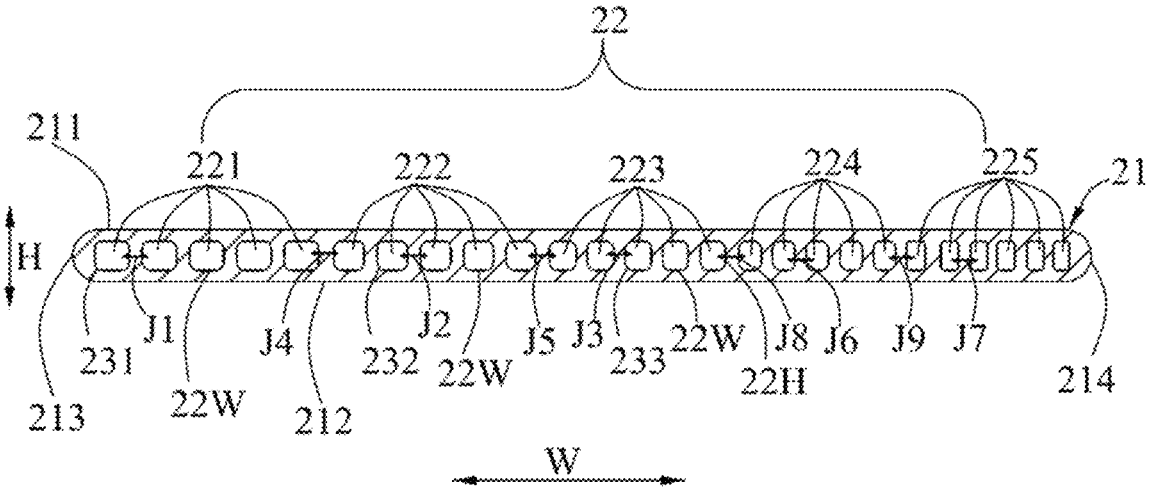
FIG. 2 is a schematic cross-sectional view of a microchannel flat tube shown in FIG. 1.
Figure 3:
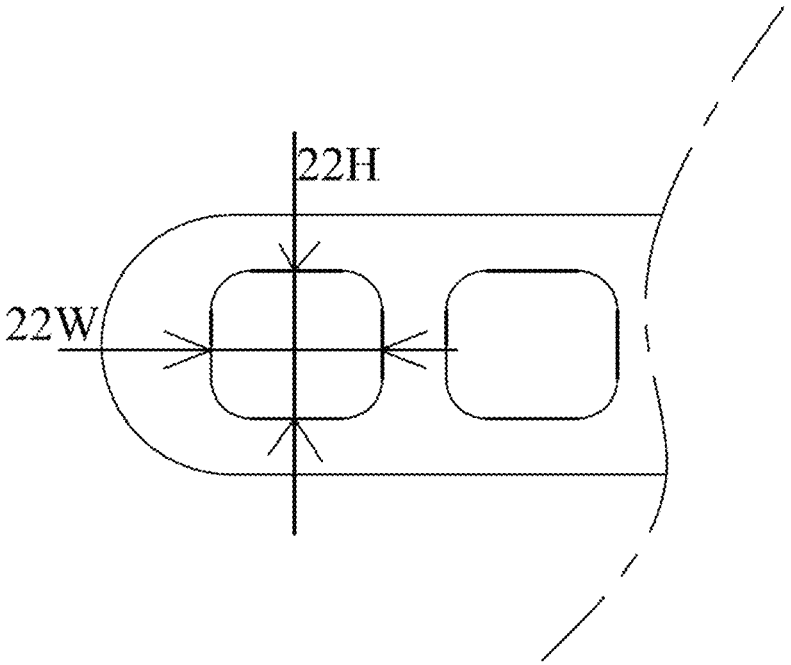
FIG. 3 is a partially enlarged schematic view of the microchannel flat tube shown in FIG. 2.
Figure 4:
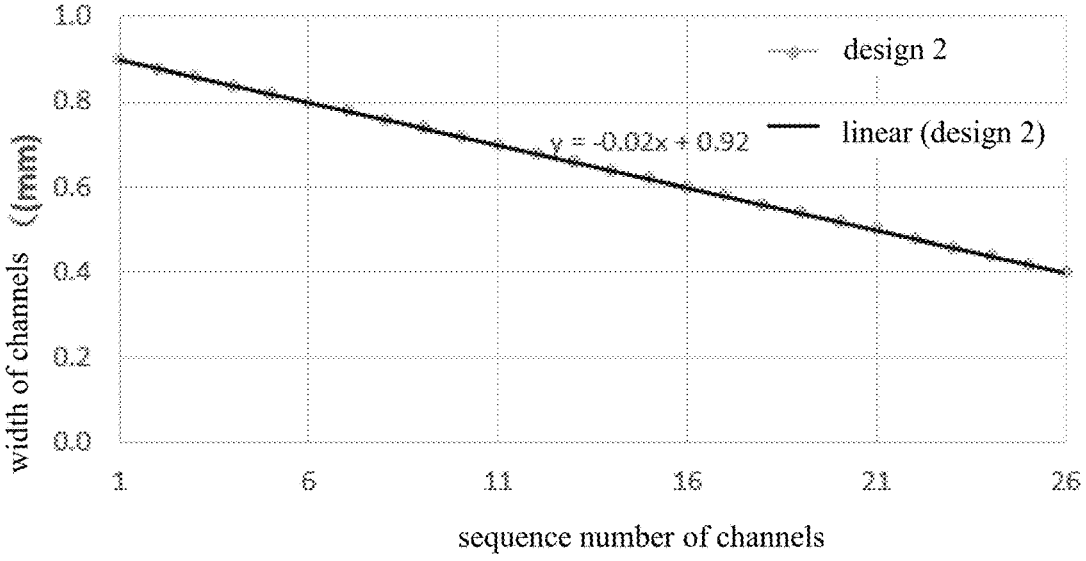
FIG. 4 is a schematic view showing relationships between channel widths and channel numbers of channels of the microchannel flat tube shown in FIG. 1.

Here, exemplary embodiments will be described in detail, and examples thereof are shown in the drawings. When the following description refers to the drawings, unless otherwise indicated, same numbers in different drawings indicate the same or similar elements. The embodiments described in the following exemplary embodiments do not represent all implementation embodiments consistent with the present application. On the contrary, they are only examples of devices and methods consistent with some aspects of the present application as described in detail in the accompanying claims.

The terms used in the present application are only for the purpose of describing specific embodiments and are not intended to limit the present application. In the description of present application, it should be understood that the terms "center", "longitudinal", "transverse", "length", "width", "thickness", "upper", "lower", "front", "back", "left", "right", "vertical", "horizontal", "top", "bottom", "inner", "outer", "clockwise", "counterclockwise" and other directions or positional relationships are based on the orientation or positional relationships shown in the drawings. They are only for the convenience of describing the present application and simplifying the description, and do not indicate or imply that the device or element referred to must have a specific orientation, be constructed and operated in a specific orientation. Therefore, they cannot be understood as a restriction of the present application. In addition, the terms "first" and "second" are only used for descriptive purposes, and cannot be understood as indicating or implying relative importance or implicitly indicating the number of indicated technical features. Thus, the features defined with "first" and "second" may explicitly or implicitly include one or more of these features. In the description of present application, "a plurality of" means two or more than two, unless otherwise specifically defined.

In the description of present application, it should be noted that, unless otherwise clearly defined and limited, the terms "installation", "connection" and "communication" should be interpreted broadly. For example, it can be a fixed connection, a detachable connection or an integral connection. It can be a mechanical connection or an electrical connection. It can be a direct connection or an indirect connection through an intermediary. It can be a communication between two elements or an interaction between two elements. For those of ordinary skill in the art, the specific meanings of the above terms in present application can be understood according to specific circumstances.

In present application, unless expressly stipulated and defined otherwise, a first feature located "above" or "under" a second feature may include the first feature and the second feature are in direct contact, or may include the first feature and the second feature are not in direct contact but through other features between them. Moreover, the first feature located "above", "on top of" and "on" the second feature includes the first feature is located directly above and obliquely above the second feature, or it simply means that the level of the first feature is higher than the second feature. The first feature located "below", "at bottom of" and "under" the second feature includes the first feature is located directly below and obliquely below the second feature, or it simply means that the level of the first feature is lower than the second feature. The exemplary embodiments of the present application will be described in detail below with reference to the drawings. In the case of no conflict, the following embodiments and features in the embodiments can be mutually supplemented or combined.

The terms used in present application are only for the purpose of describing specific embodiments and are not intended to limit the application. The singular forms of "a", "said" and "the" used in present application and the appended claims are also intended to include plural forms, unless the context clearly indicates other meanings.

The exemplary embodiments of the present application will be described in detail below with reference to the drawings. In the case of no conflict, the following embodiments and features in the implementation can be combined with each other.

FIGS. 1 to 4 show a microchannel heat exchanger 100 in accordance with the present application. The microchannel heat exchanger 100 includes a first collecting pipe 11, a second collecting pipe 12, a plurality of microchannel flat tubes 2 and a plurality of fins 3. The plurality of microchannel flat tubes 2 are arranged parallel to each other, and are connected side by side between the first collecting pipe 11 and the second collecting pipe 12. Each fin 3 is sandwiched between two adjacent microchannel flat tubes 2.

The microchannel flat tube 2 includes a flat tube body 21 and a row of channels 22 extending through the flat tube body 21. A length of the flat tube body 21 is greater than a width of the flat tube body 21, and the width is greater than the thickness of the flat tube body 21. The flat tube body 21 includes a first plane 211, a second plane 212, a first side surface 213 and a second side surface 214. The first plane 211 and the second plane 212 are arranged on two opposite sides of the flat tube body 21 in a thickness direction H. The first side surface 213 and the second side surface 214 are disposed on two opposite sides of the flat tube body 21 in a width direction W. The first side surface 213 connects the first plane 211 and the second plane 212. The second side surface 214 connects the first plane 211 and the second plane 212. In this embodiment, the first side surface 213 and the second side surface 214 are arc-shaped. In other alternative embodiments, the first side surface 213 and the second side surface 214 may also be of flat or other shapes, as long as they serve to connect the first flat surface 211 and the second flat surface 214. The shapes in the present application are not limited to these described herein.

A row of channels 22 communicate with an inner cavity of the first collecting pipe 11 and an inner cavity of the second collecting pipe 12. The row of channels 22 are arranged in the flat tube body 21 along the width direction W. The row of channels 22 extend through the flat tube body 21 along the length direction L. Each channel 22 includes a first width 22W along the width direction W and a first height 22H along the thickness direction H. The row of channels 22 include a first channel 221, a second channel 222 and a third channel 223 arranged in the width direction. The first heights 22H of the first channel 221, the second channel 222 and the third channel 223 are equal in dimension. The first widths 22W of the first channel 221, the second channel 222 and the third channel 223 are decreased at a fixed rate. In other words, the first width 22W of the first channel 221, the first width 22W of the second channel 222, and the first width 22W of the third channel 223 vary according to a linear function. In addition, perimeters and cross sections of the first channel 221, the second channel 222 and the third channel 223 are also decreased at a linear/fixed rate. Cross-sectional areas of the first channel 221, the second channel 222 and the third channel 223 vary according to a linear function. The widths of the first channel 221, the second channel 222 and the third channel 223 satisfy a relationship: $y=-mx+n$, where x represents sequence numbers of the first channel 221, the second channel 222 and the third channel 22; and y represents a dimension of the first width of the corresponding x-th channel. The first channel 221 is adjacent to the second channel 222, and the second channel 222 is adjacent to the third channel 223; or there are other channels spaced between the first channel 221 and the second channel 222 in which the other channels may have the same or different shapes as the first channel 221 and the second channel 222. There are other channels spaced between the second channel 222 and the third channel 223 in which the other channels may have the same or different shapes as the first channel 221 and the second channel 222. The first channel 221 is adjacent to the first side surface 213, and the third channel is adjacent to the second side surface 214. The first side surface 213 is a windward surface, and the second side surface 214 is a leeward surface. Therefore, when the refrigerant flows in the microchannel flat tube 2, the first channel 221 adjacent to the windward side has a larger flow cross-sectional area so that the heat exchange is more sufficient. The third channel 223 adjacent to the leeward side has a smaller flow area so that the heat exchange becomes smaller. Because the wind has been cooled after heat exchange on the windward side, the heat exchange capacity on the leeward side becomes smaller. At this time, the cross-sectional area of the channel on the leeward side is correspondingly reduced, so as to obtain a higher heat exchange efficiency within the same flat tube volume. While improving the heat exchange efficiency, since the first heights 22H of the row of channels 22 are equal in dimension, the first widths 22W are decreased at a fixed rate and the heights become gradually decreased, which can reduce the thickness of the microchannel flat tube. Thus, this is beneficial to further improvement of heat exchange efficiency, while saving material cost and occupying space.

The row of channels 22 include a group of first channels 221, a group of second channels 222 and a group of third channels 223. The group of first channels 221 include five first channels 221. The group of second channels 222 include five second channels 222. The group of third channels 223 include five third channels 223. Alternatively, the group of first channels 221, the group of second channels 222 and the group of third channels 223 may also have other numbers, which is not limited by the present application. The number of the group of first channels 221 is equal to the number of the group of second channels 222, and the number of the group of first channels 221 is equal to the number of the group of third channels 223. This design facilitates the stepped change of the channels, and facilitates the processing of the microchannel flat tubes while ensuring the heat exchange efficiency.

Each cross-sectional area of the first channel 221, the second channel 222, and the third channel 223 is of a rectangular shape with rounded corners. The first channel 221 includes four first chamfers 231, the second channel 222 includes four second chamfers 232, and the third channel 223 includes four third chamfers 233. The radius of the first chamfer 231, the radius of the second chamfer 232 and the radius of the third chamfer 233 are equal or decreased at a fixed rate. In this embodiment, the radius of the first chamfer 231 and the radius of the second chamfer 232 are equal.

Distances J1 between two adjacent first channels 221 in the group of first channels 221 are equal. Distances J2 between two adjacent second channels 222 in the group of second channels 222 are equal. Distances J3 between two adjacent third channels 233 in the group of third channels 223 are equal. A distance J4 between the adjacent first channel 221 and the second channel 222 is greater than or equal to a distance J5 between the adjacent second channel 222 and the third channel 223. The distance J4 between the adjacent first channel 221 and the second channel 222 is equal to the distance J1 between two adjacent first channels 221. The distance J5 between the adjacent second channel 222 and the third channel 223 is equal to the distance J3 between two adjacent third channels 223. Moreover, the distance J5 between the adjacent second channel 222 and the third channel 223 is smaller than the distance J2 between two adjacent second channels 222.

As an alternative embodiment, the row of channels 22 further include five fourth channels 224 and six fifth channels 225. Distances J6 between two adjacent fourth channels 224 in the group of fourth channels 224 are equal. Distances J7 between two adjacent fifth channels 225 in the group of fifth channels 225 are equal. A distance J8 between the adjacent third channel 223 and the fourth channel 224 is equal to a distance J9 between the adjacent fourth channel 224 and the fifth channel 225.

As an alternative embodiment, a width of the microchannel flat tube 2 is 25.4 mm, and a thickness of the microchannel flat tube 2 is 1.3 mm. The first channels 221, the second channels 222, the third channels 233, the fourth channels 224 and the fifth channels 225 have the same first height 22H which is 0.74 mm. A distance between the first channels 221, the second channels 222, the third channels 233, the fourth channels 224 and the fifth channels 225 from the first plane is 0.28 mm, and a distance between the first channels 221, the second channels 222, the third channels 233, the fourth channels 224 and the fifth channels 225 from the second plane is 0.28 mm. Dimensions of the first widths 22H of the first channels 221, the second channels 222, the third channels 233, the fourth channels 224 and the fifth channels 225 are 0.86 mm, 0.76 mm, 0.66 mm, 0.56 mm and 0.46 mm, respectively. Dimensions of J1, J2 and J4 are all 0.32 mm, and dimensions of J3, J5, J6, J7, J8 and J9 are all 0.28 mm. The radius of the chamfers of the first channels 221, the second channels 222, the third channels 233 and the fourth channels 224 are all 0.2 mm. The radius of the chamfer of the fifth channels 225 is 0.1 mm.

As another alternative embodiment, the first widths 22H of the five first channels 221 may also be sequentially decreased. For example, the first widths 22W of the five second channels 221 are 0.90 mm, 0.88 mm, 0.86 mm, 0.84 mm, 0.82 mm, respectively. The first widths 22W of the five second channels 222 can also be decreased in sequence. For example, the first widths 22W of the five second channels 222 are 0.80 mm, 0.78 mm, 0.76 mm, 0.74 mm, 0.62 mm, respectively. The first widths 22W of the five third channels 223 may also be sequentially decreased. For example, the first widths 22W of the five third channels 223 are 0.70 mm, 0.68 mm, 0.66 mm, 0.64 mm, 0.62 mm, respectively. The first widths 22W of the five fourth channels 224 may also be sequentially decreased. For example, the first widths 22W of the five fourth channels 224 are 0.50 mm, 0.58 mm, 0.56 mm, 0.54 mm, 0.52 mm, respectively. The first widths 22H of the six fifth channels 225 may also be sequentially decreased. For example, the first widths 22W of the six fourth channels 224 are 0.40 mm, 0.48 mm, 0.46 mm, 0.44 mm, 0.42 mm, 0.40 mm, respectively. In this way, the first widths 22W of the row of channels 22 satisfy a relationship: $y=-0.02x+0.92$, where x represents sequence numbers of the row of channels 22 from left to right, and y represents a dimension of the first width 22W of the corresponding x-th channel. Relatively speaking, dimensions of the first widths 22H of the five first channels 221, the five second channels 222, the five third channels 233, the five fourth channels 224 and the six fifth channels 225 are 0.86 mm, 0.76 mm, 0.66 mm, 0.56 mm and 0.46 mm, respectively. These dimensions of the first widths 22H are easier to process and easier to control tolerances. Of course, since specific dimensions of the first widths 22W exemplified in present application is an alternative embodiment, other specific dimensions may also be selected as long as it is satisfied that the dimensions of the first widths of the row of channels 22 change sequentially according to a linear function or change according to a linear function in groups. Of course, the above-mentioned slight changes in dimensions due to processing errors are also within the protection scope of the present application.

Figure 5:
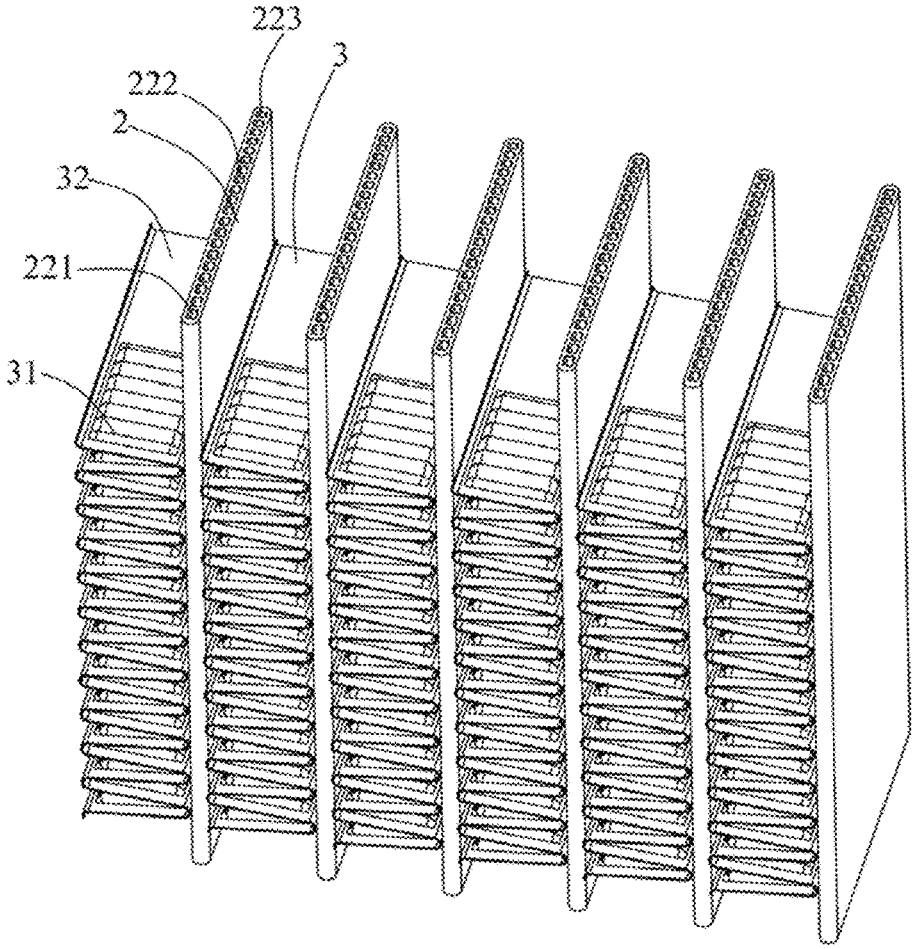
FIG. 5 is a schematic perspective view of microchannel flat tubes and fins in accordance with another embodiment of the present application.
Figure 6:
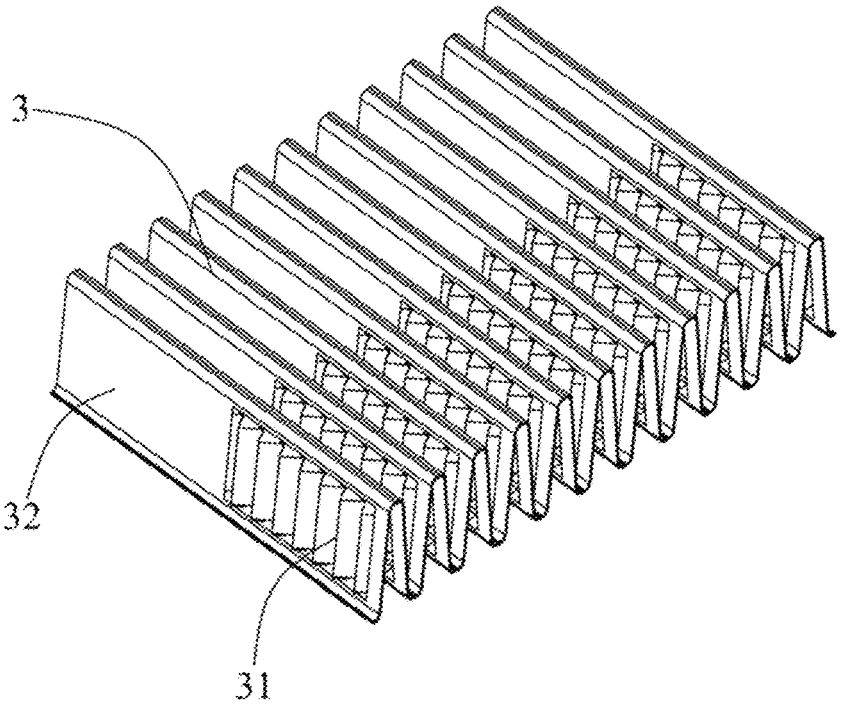
FIG. 6 is a schematic perspective view of the fins as shown in FIG. 5.
Figure 7:
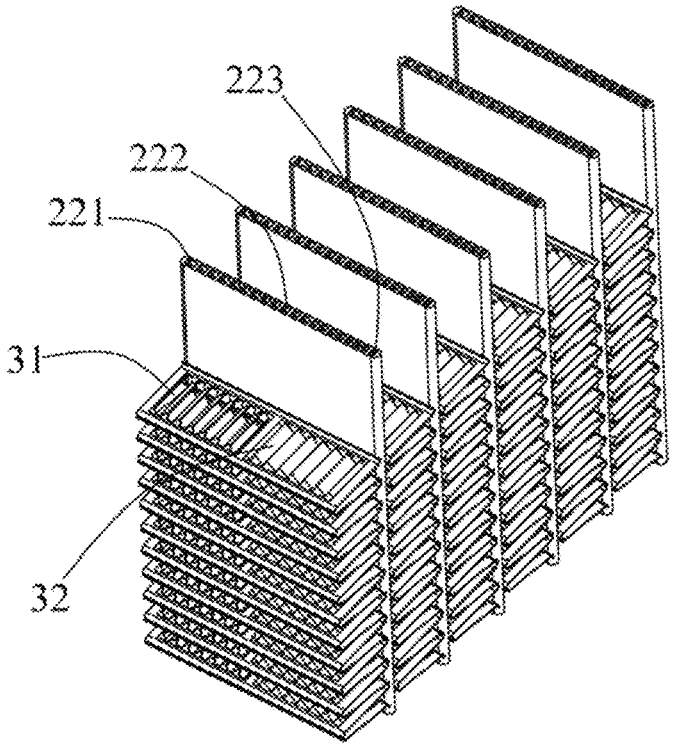
FIG. 7 is a schematic perspective view of microchannel flat tubes and fins in accordance with another embodiment of the present application.

As shown in FIGS. 5 and 6, the fin 3 includes a first portion 31 adjacent to the first channels 221 and a second portion 32 adjacent to the third channels 223. The shape of the first portion 31 is different from that of the second portion 32. The fin 3 is a louver fin, the first portion 31 is windowed, and the second portion 32 is not windowed. Openings of the first portion 31 can increase the turbulence on the windward side, thereby enhancing the heat exchange near the first channels 221. The unopened second portion 32 decreases the turbulence near the leeward side, thereby reducing the wind resistance and reducing the heat exchange of the third channels 223 near the leeward side. As a result, the overall heat exchange effect is improved and the wind resistance is reduced, which is beneficial to improve the heat exchange efficiency of the heat exchanger. Of course, as shown in FIG. 7, in other embodiments, the opening density of the first portion 31 is greater than the opening density of the second portion 32 to achieve the above-mentioned function of improving the heat exchange efficiency of the heat exchanger.

In some alternative embodiments, the fin 3 includes a first portion 31 adjacent to the first channels 221 and a second portion 32 adjacent to the third channels. The density of the first portion 31 is different from the density of the second portion 32. The fins 3 are louvered fins, and the density of the first portion 31 is greater than the density of the second portion 32, which can also achieve the function of improving the heat exchange efficiency of the heat exchanger.

When the heat exchanger is working, wind generated by an external fan passes through the first side surface 213 adjacent to the first channels 221, passes through the fins 3, and then flows out from a position adjacent to the third channels 223. Therefore, when the refrigerant flows in the microchannel flat tubes 2, the first channels 221 adjacent to the windward side has a larger flow cross-sectional area so that the heat exchange is more sufficient. The third channels 223 adjacent to the leeward side have smaller flow areas so that the heat exchange is reduced. Because the wind has been cooled after heat exchange on the windward side, the heat exchange capacity on the leeward side becomes smaller. At this time, the cross-sectional area of the channels on the leeward side is correspondingly reduced, so that a higher heat exchange efficiency is obtained within the same flat tube volume, and the heat exchange efficiency of the microchannel heat exchanger is improved.

The above embodiments are only used to illustrate the present application and not to limit the technical solutions described in the present application. The understanding of this specification should be based on those skilled in the art. Descriptions of directions, such as "front" and "back", although they have been described in detail in the above-mentioned embodiments of the present application, those skilled in the art should understand that modifications or equivalent substitutions can still be made to the application, and all technical solutions and improvements that do not depart from the spirit and scope of the application should be covered by the claims of the application.

What is claimed is:

1. A microchannel flat tube, comprising:

a flat tube body comprising a first plane, a second plane, a first side surface and a second side surface, the first plane and the second plane being disposed on opposite sides of the flat tube body along a thickness direction, respectively, the first side surface and the second side surface being disposed on opposite sides of the flat tube body along a width direction, respectively, the first side surface connecting the first plane and the second plane, the second side surface connecting the first plane and the second plane; and a row of channels disposed in the flat tube body along the width direction, the row of channels being adapted for an refrigerant to flow therethrough, the row of channels extending through the flat tube body along a length direction, each channel comprising a first width in the width direction and a first height in the thickness direction, the row of channels at least comprising a first group of first channels, a second group of second channels and a third group of third channels, the second group of second channels being disposed adjacent to the first group of first channels without any channel disposed between the second group of second channels and the first group of first channels along the width direction, the third group of third channels being disposed adjacent to the second group of second channels without any channel disposed between the third group of third channels and the second group of second channels along the width direction, the first channels, the second channels and the third channels being disposed in sequence along the width direction;

wherein the first channels, the second channels and the third channels have the same first height, and the first channels, the second channels and the third channels have first widths which are decreased at a fixed value, so that flow areas of the first channels, the second channels and the third channels decrease in a linear relationship;

wherein the number of the first channels in the first group is equal to the number of the second channels in the second group.

2. The microchannel flat tube according to claim 1, wherein the number of the first channels in the first group is equal to the number of the third channels in the third group.

3. The microchannel flat tube according to claim 1, wherein each cross-sectional area of the first channels, the second channels and the third channels is of a rectangular shape with rounded corners, each first channel comprises four first chamfers, each second channel comprises four second chamfers, and each third channel comprises four third chamfers.

4. The microchannel flat tube according to claim 3, wherein a radius of the first chamfer, a radius of the second chamfer and a radius of the third chamfer are equal or decreased at a fixed value.

5. The microchannel flat tube according to claim 1, wherein a group distance between the first group of the first channels and the second group of the second channels is greater than or equal to a group distance between the second group of the second channels and the third group of the third channels.

6. The microchannel flat tube according to claim 2, wherein distances between two adjacent first channels in the first group are equal, distances between two adjacent second channels in the second group are equal, and distances between two adjacent third channels in the third group are equal.

7. The microchannel flat tube according to claim 6, wherein a group distance between the first group of the first channels and the second group of the second channels is equal to the distance between two adjacent first channels in the first group.

8. The microchannel flat tube according to claim 6, wherein a group distance between the second group of the second channels and the third group of the third channels is equal to the distance between two adjacent third channels in the third group;

and wherein the group distance between the second group of the second channels and the third group of the third channels is smaller than the distance between two adjacent second channels in the second group.

9. The microchannel flat tube according to claim 1, wherein the widths of the first channels, the second channels and the third channels satisfy a relationship: $y=-mx+n$, wherein x represents a sequence number of the first channels, the second channels and the third channels, and y represents a dimension of the first width of a corresponding x-th channel.

10. The microchannel flat tube according to claim 1, wherein the widths of the first channels, the second channels and the third channels satisfy a relationship: $y=-0.02x+0.92$, wherein x represents a sequence number of the first channels, the second channels and the third channels, and y represents a dimension of the first width of a corresponding x-th channel.

11. The microchannel flat tube according to claim 1, wherein the first channel farthest away from the third group of the third channels is located adjacent to the first side surface, the third channel farthest away from the first group of the first channels is located adjacent to the second side surface, the first side surface is a windward surface and the second side surface is a leeward surface.

12. A microchannel heat exchanger, comprising: a plurality of microchannel flat tubes, a first collecting pipe, a second collecting pipe and fins;

the microchannel flat tube comprising a flat tube body and a row of channels;

the flat tube body comprising a first plane, a second plane, a first side surface and a second side surface, the first plane and the second plane being disposed on opposite sides of the flat tube body along a thickness direction, respectively, the first side surface and the second side surface being disposed on opposite sides of the flat tube body along a width direction, respectively, the first side surface connecting the first plane and the second plane, the second side surface connecting the first plane and the second plane;

the row of channels being disposed in the flat tube body along the width direction, the row of channels extending through the flat tube body along a length direction, each channel comprising a first width in the width direction and a first height in the thickness direction, the row of channels at least comprising a first group of first channels, a second group of second channels and a third group of third channels, the second group of second channels being disposed adjacent to the first group of first channels without any channel disposed between the second group of second channels and the first group of first channels along the width direction, the third group of third channels being disposed adjacent to the second group of second channels; the first channels, the second channels and the third channels being disposed in sequence along the width direction; wherein the first channels, the second channels and the third channels have the same first height, and the first channels, the second channels and the third channels have first widths which are decreased at a fixed value, so that flow areas of the first channels, the second channels and the third channels decrease in a linear relationship; wherein the microchannel flat tubes are connected between the first collecting pipe and the second collecting pipe, each fin is sandwiched between two adjacent microchannel flat tubes, and the row of channels of each microchannel flat tube communicates with an inner cavity of the first collecting pipe and an inner cavity of the second collecting pipe;

wherein the number of the first channels in the first group is equal to the number of the second channels in the second group.

13. The microchannel heat exchanger according to claim 12, wherein each fin comprises a first portion adjacent to the first channels and a second portion adjacent to the third channels; and wherein the first portion and the second portion have different shapes.

14. The microchannel heat exchanger according to claim 13, wherein each fin is a louvered fin, the first portion is windowed, and the second portion is not windowed.

15. The microchannel heat exchanger according to claim 12, wherein each fin comprises a first portion adjacent to the first channels and a second portion adjacent to the third channels; and wherein an opening density of the first portion is different from an opening density of the second portion.

16. The microchannel heat exchanger according to claim 15, wherein each fin is a louvered fin, and the opening density of the first portion is greater than the opening density of the second portion.

17. The microchannel heat exchanger according to claim 12, wherein the first channel farthest away from the third group of third channels is located adjacent to the first side surface, the third channel farthest away from the first group of first channels is located adjacent to the second side surface; and wherein when the microchannel heat exchanger is working, wind generated by an external fan passes across the first side surface, passes through the fins, and then flows out from a position adjacent to the third channels.

18. A microchannel heat exchanger, comprising:

a first collecting pipe comprising a first inner cavity;

a second collecting pipe comprising a second inner cavity; and a plurality of microchannel flat tubes connecting between the first collecting pipe and the second collecting pipe, each flat tube defining a row of channels fluid communicating the first inner cavity and the second inner cavity;

each microchannel flat tube comprising a first plane, a second plane, a first side surface and a second side surface, the first plane and the second plane being disposed on opposite sides of the flat tube body along a thickness direction, respectively, the first side surface and the second side surface being disposed on opposite sides of the flat tube body along a width direction, respectively, each channel extending through the flat tube body along a length direction;

the row of channels comprising a first channel, a second channel and a third channel disposed in sequence along the width direction;

wherein heights of the first channel, the second channel and the third channel are same, and widths of the first channel, the second channel and the third channel are decreased at a fixed value.

19. The microchannel heat exchanger according to claim 18, further comprising a plurality of louvered fins each sandwiched between two adjacent microchannel flat tubes, the first channel being adjacent to the first side surface, the third channel being adjacent to second side surface;

wherein each louvered fin comprises a first portion adjacent to the first channel and a second portion adjacent to the third channel, the first portion is windowed, and the second portion is not windowed.

* * * * *